US006561629B2

(12) United States Patent
Yamada et al.

(10) Patent No.: US 6,561,629 B2
(45) Date of Patent: May 13, 2003

(54) CHARGING/DEFLECTING DEVICE CAPABLE OF EFFECTIVELY DEFLECTING INK DROPLET

(75) Inventors: Takahiro Yamada, Hitachinaka (JP); Kunio Satou, Hitachinaka (JP); Shinya Kobayashi, Hitachinaka (JP); Hitoshi Kida, Hitachinaka (JP); Kazuo Shimizu, Hitachinaka (JP); Toshitaka Ogawa, Hitachinaka (JP); Yoshikane Matsumoto, Hitachinaka (JP); Lee Chahn, Hitachi (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/095,468

(22) Filed: Mar. 13, 2002

(65) Prior Publication Data

US 2002/0130926 A1 Sep. 19, 2002

(30) Foreign Application Priority Data

Mar. 16, 2001 (JP) ..... 2001-075193

(51) Int. Cl.[7] ..... B41J 2/06
(52) U.S. Cl. ..... 347/55

(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,975,683 A 11/1999 Smith et al. ..... 347/55

*Primary Examiner*—Raquel Yvette Gordon
(74) *Attorney, Agent, or Firm*—Whitham, Curtis, & Christofferson, P.C.

(57) ABSTRACT

A back electrode 30 is provided at a rear surface side of a recording sheet 60. An orifice electrode 11 is attached to an orifice plate 15 of a head module 10. The orifice electrode 11, the orifice plate 15, and ink filling in a nozzle element 2 are electrically connected to the ground. The back electrode 30 has the potential corresponding to that of a charging/deflecting signal. With this configuration, the orifice electrode 11, a pressure chamber 13, and the back electrode 30 together generates an inclined electric field 85 at a position a close to a center trajectory 90. A charged ink droplet is deflected greatly by the inclined electric field 85, at an early stage of the ink flight, and even greater deflection can be achieved as the flight proceeds.

11 Claims, 7 Drawing Sheets

A
a1
a2
a3
a4
a5
a6
T1 T2 T3 T4 T5 T6
T T

DRIVING-PULSE SIGNAL
b1
b2
b6

CHARGING/ DEFLECTING SIGNAL
c1
0V
-1kV

DRIVING-PULSE SIGNAL
d1
+1kV
0V
-1kV

CHARGING/ DEFLECTING SIGNAL
+1kV
0V
-1kV

CHARGING/DEFLECTING DEVICE CAPABLE OF EFFECTIVELY DEFLECTING INK DROPLET

BACKGROUND OF THE INVENTION

1. Field of the Invention

The present invention relates to an ink jet recording device, and specifically to an ink jet recording device capable of reliably providing high quality images at a high printing speed.

2. Related Art

There has been proposed a line scanning type ink jet printer, capable of printing images on an elongated uncut recording sheet at a high printing speed. This type of printer includes a head having a plurality of nozzles and an elongated width covering over the entire width of the recording sheet. When printing images, ink droplets are ejected from the nozzles based on a recording signal and alight or impact on the recording sheet that is being fed at a high speed in its longitudinal direction. By controlling both the ink ejection and the feed of the recording sheet, a desired image is provide on the recording sheet.

There are two types of line scanning type ink jet printer. One includes a continuous ink jet head, and the other includes an on-demand ink jet head. Although the printer with the on-demand ink jet head is slow in printing speed compared with the printer with the continuous ink jet head, the on-demand ink jet head requires a simple ink system, and so is well suited for general-purpose high-speed printers.

An on-demand ink jet head of a line-scanning type ink jet printer is formed with a plurality of nozzle lines, each including a plurality of nozzles aligned in a line. Each of the nozzles includes an ink chamber and is provided with an energy generating member, such as a piezoelectric element or a heat generating element. When a driving voltage is selectively applied to the energy generating member, ink in the ink chamber is applied with pressure, and some of the ink is ejected as an ink droplet through a nozzle hole.

The present inventors have invented an ink jet printer including such ink jet head and, in addition, charger/deflector electrodes. The charger/deflector electrodes charge an ink droplet ejected from the nozzle and also generate a deflector electric field that deflects the charged ink droplets in flight, thereby controlling a position on the recording sheet to alight or impact (hereinafter referred to as "impact position"). In this type of ink jet printer, a plurality of ink droplets ejected from different nozzles can be controlled to alight on the same single spot to form a single dot on the recording sheet. Because each dot on the recording sheet is formed from a plurality of ink droplets from different nozzles, even if one or ones of the different nozzles become defective, the dot is still formed by the remaining nozzle(s). Therefore, images can be formed reliably. Also, because each dot is formed by a plurality of different nozzles, bands of darker or lighter gray tones and lines on the printed image due to uneven characteristics among the plurality of nozzles can be canceled out, and so a high quality image, without uneven color density or a white line across the page, can be provided.

U.S. Pat. No. 5,975,683 discloses an electrically insulated steering electrode positioned near the nozzle hole. The steering electrode steers a charged droplet in a desired direction when charged with a voltage. There is also disclosed other type of steering electrode, which is positioned behind a recording sheet, rather than near the nozzle hole. These electrodes could be used in principle as the above charger/deflector electrode.

SUMMARY OF THE INVENTION

However, a conventional deflector electrode is insufficient in its operational reliability or in its deflecting capability. Specifically, an electrically insulated deflector electrode provided near the nozzle hole may get wet with ink. This unstabilizes a generated deflector electric field and prevents a desirable deflection control. Also, electrically insulated deflector electrode may be deteriorated in its insulating performance when get wet with ink, inhibiting a deflector voltage from being applied to the deflector electrode. The insulating performance will also be deteriorated due to chemical reaction, such as oxygenation, carbonization, and the like.

On the other hand, a deflector electrode provided behind a recording sheet is relatively far away from the nozzle hole, so that there is generated only a deflector electric field that cannot effectively deflect charged ink droplets in flight. Accordingly, a sufficient deflection amount cannot be provided.

It is an object of the present invention to provide a highly reliable charger/deflector device that generates a deflector electric field capable of effectively deflecting charged ink droplets from an early flight stage.

It is also an object of the present invention to provide a charger/deflector device that includes a deflector electrode with an excellent deflection performance and that is well suited for an ink droplet deflection type on-demand ink jet printer.

In order to achieve the above and other objectives, there is provided a charging/deflecting device used in a device including a nozzle member that is formed with an ink chamber filled with an ink and an ejection means for ejecting a portion of the ink as an ink droplet. The charging/deflecting device includes an electrically conductive member, a back electrode, and an application member. The electrically conductive member is provided near a position where the ink droplet is generated by separating from the remaining ink at the time of ejection, and has the same potential as that of the ink filling in the ink chamber. The back electrode is positioned defining a space between the electrically conductive member through which a recording medium passes. The application member applies an electric voltage to the back electrode, thereby generating an inclined electric field between the electrically conductive member and the back electrode.

There is also provided an ink jet recording device including a nozzle member that is formed with an ink chamber filled with an ink, an ejection means for ejecting a portion of the ink as an ink droplet, an electrically conductive member, a back electrode, and an application member. The electrically conductive member is provided near a position where the ink droplet is separated from the remaining ink at that time of ink ejection. The electrically conductive member has the same potential as the potential of the ink filling in the ink chamber. The back electrode is positioned defining a space between the electrically conductive member through which a recording medium passes. The application member selectively applies an electric voltage to the back electrode, thereby generating an inclined electric field between the electrically conductive member and the back electrode.

BRIEF DESCRIPTION OF THE DRAWINGS

In the drawings:

FIG. 5(*b*) is a timing chart of an example of a driving-pulse signal;

FIG. 5(*c*) is a timing chart of an example of a charging/deflecting signal;

FIG. 5(*d*) is a timing chart of another example of charging/deflecting signal;

FIG. 5(*e*) is a timing chart of still another example of charging/deflecting signal;

PREFERRED EMBODIMENT OF THE PRESENT INVENTION

Next, a preferred embodiment of the present invention will be described while referring to the attached drawings.

Figure 1:
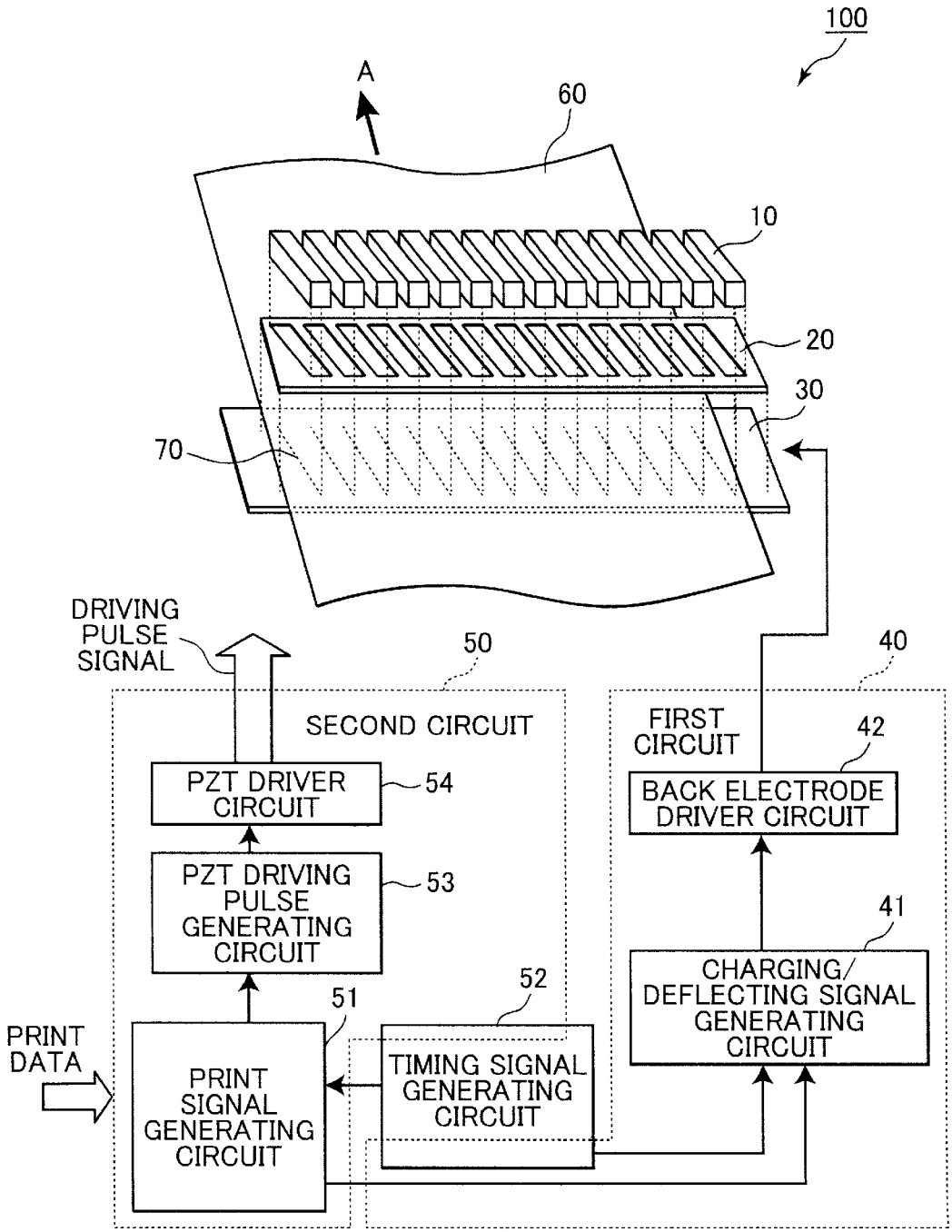
FIG. 1 is an exploded simplified view with partially block diagram showing an overall configuration of an ink jet recording device including a charging/deflection device according to an embodiment of the present invention.

FIG. 1 shows an overall configuration of an on-demand ink jet printer 100 including a charger/deflector device according to an embodiment of the present invention. As shown in FIG. 1, the ink jet printer 100 includes a plurality of head modules 10, a head module mounting member 20, a back electrode 30, a first circuit 40, and a second circuit 50. Although not shown in the drawings, there is also provided a sheet feed mechanism for feeding a recording sheet 60 in a sheet feed direction indicated by an arrow A.

The head module mounting member 20 mounts the plurality of head modules 10. The back electrode 30 is positioned behind the recording sheet 60 such that the back electrode 30 confronts the head module mounting member 20 with the recording sheet 60 interposed therebetween. In other words, a pathway of the recording sheet 60 is defined between the back electrode 30 and the head module mounting member 20.

The second circuit 50 includes a print-signal generating circuit 51, a timing-signal generating circuit 52, a PZT-driving-pulse generating circuit 53, and a PZT driver circuit 54. The timing-signal generating circuit 52 generates timing signals and outputs the same to the print-signal-generating circuit 51 and to a charging/deflecting-signal generating circuit 41 (described later) of the first circuit 40. The print-signal generating circuit 51 generates a print-control signal based on the timing signal and print data input from an external device (not shown) The PZT-driving-pulse generating circuit 53 generates a driving-pulse signal, which is amplified by the PZT driver circuit 54 and output to the head module 10.

Figures 5A, 5B, 5C, 5D, 5E:
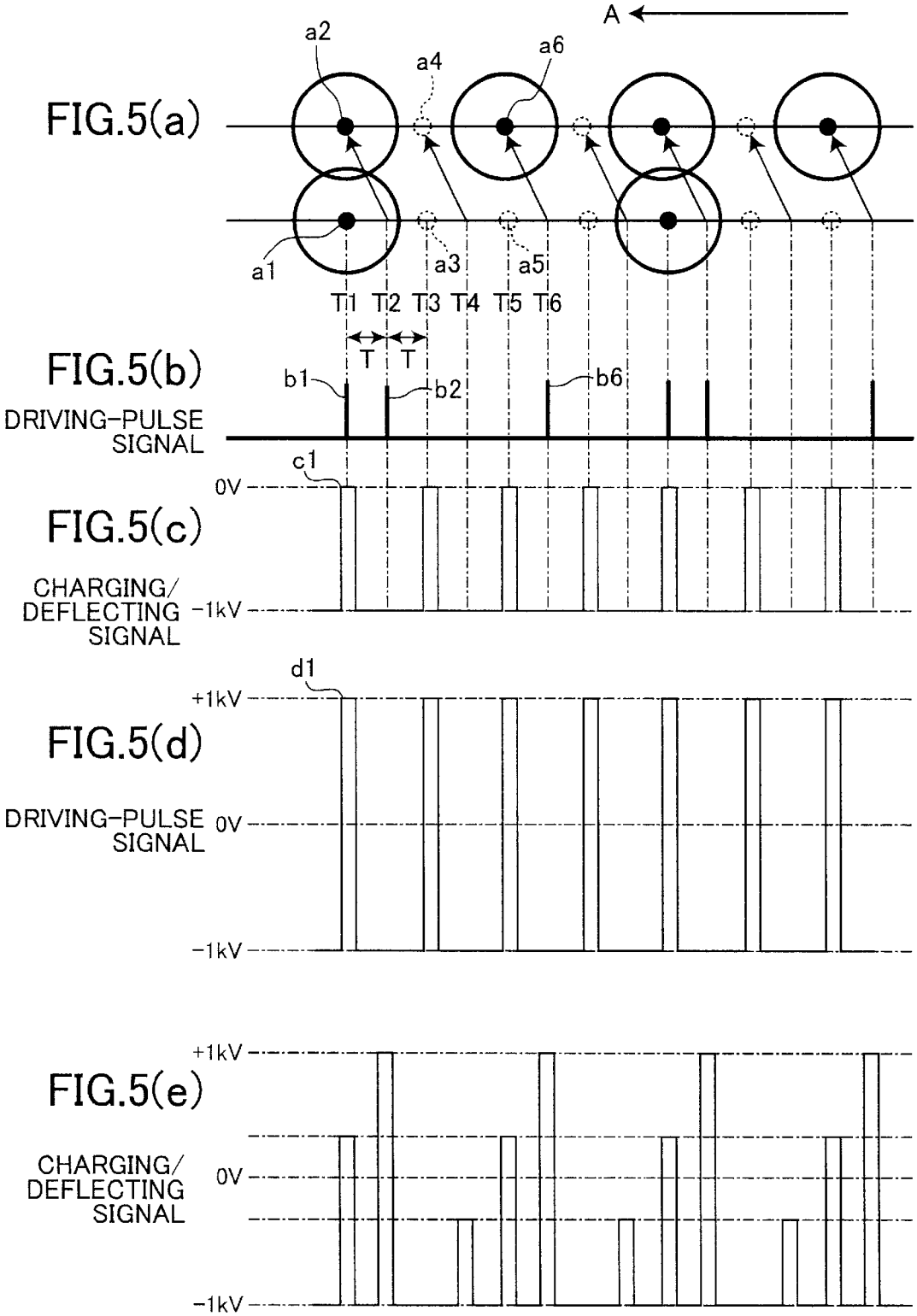
FIG. 5(*a*) is an explanatory plan view of an example of a dot pattern formed on a recording sheet with the ink jet recording device.

The first circuit 40 includes the charging/deflecting-signal generating circuit 41 and a back electrode driver circuit 42. The charging/deflecting-signal generating circuit 41 generates a predetermined charging/deflecting signal shown in FIG. 5(*c*), based on the timing signal from the timing-signal generating circuit 52 and the print control signal from the print-signal-generating circuit 51. The back electrode driver circuit 42 amplifies the charging/deflecting signal to a predetermined voltage and outputs the same to the back electrode 30. As shown in FIG. 5(*c*), the charging/deflecting signal of the present embodiment periodically changes its potential between 0V and −1 kV.

Figure 2:
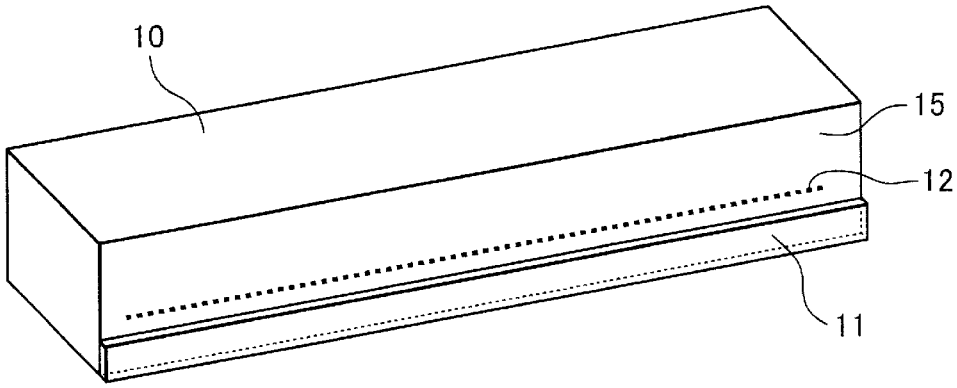
FIG. 2 is a perspective view of one of head modules of the ink jet recording device of FIG. 1.

As shown in FIG. 2, each head module 10 includes an orifice plate 15 formed of an electrically conductive material, such as metal. The orifice plate 15 is formed with n nozzle holes 12 aligned in a line at a predetermined pitch, and is provided with an orifice electrode 11 attached thereto.

The orifice electrode 11, the orifice plate 15, the back electrode 30, and the first circuit 40 together define the charger/deflector device of the present embodiment.

Figure 3:
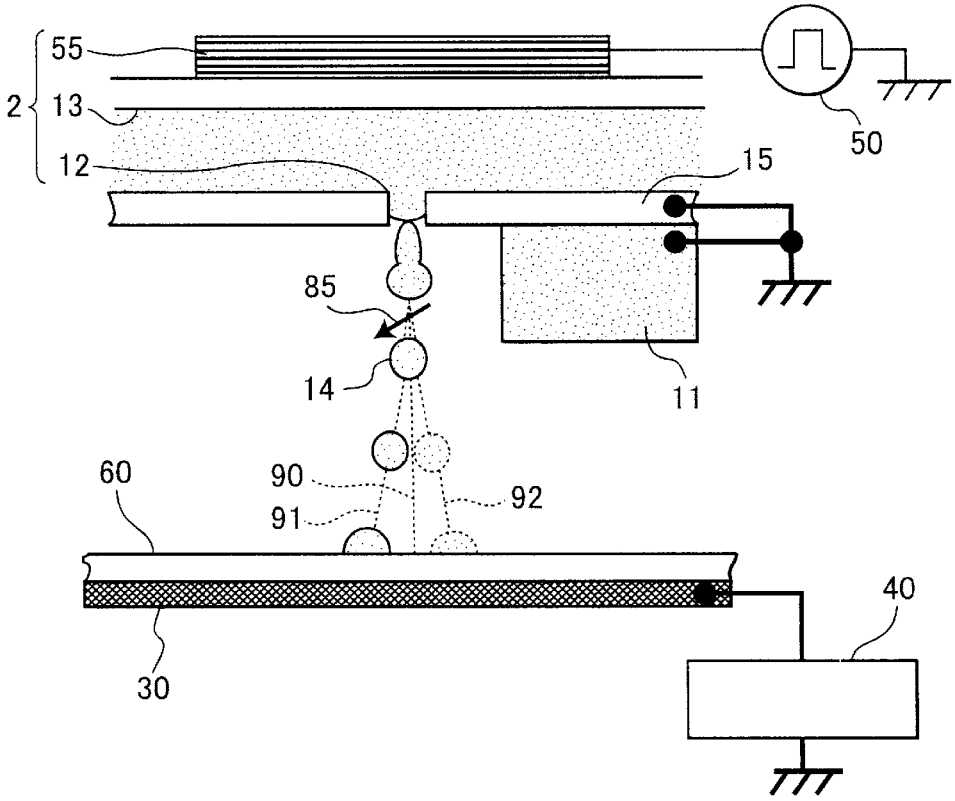
FIG. 3 is an explanatory plan view of ink deflection according to an example of the embodiment.

A configuration of the head module 10 will be described in more detail. The head module 10 is an on-demand ink jet type linear print head module. As shown in FIG. 3, each head module 10 is formed from n nozzle elements 2 (only one is shown in FIG. 3). Each nozzle element 2 has the nozzle hole 12 formed in the orifice plate 15, a pressure chamber 13, and a piezoelectric element 55. The pressure chamber 13 is fluidly connected to the corresponding nozzle hole 12 and is filled with ink. The piezoelectric element 55 is provided to the pressure chamber 13 and serves as an actuator, to which the driving-pulse signal is applied from the second circuit 50. Although not shown in the drawings, the nozzle element 2 further includes an ink inlet port for introducing ink from a manifold to the pressure chamber 13.

When the driving-pulse signal is applied to the piezoelectric element 55, the piezoelectric element 55 changes the volume of the pressure chamber 13 so that an ink droplet is ejected through the nozzle hole 12. For example, the nozzle hole 12 has a diameter of 30 $\mu$m, and approximately 10 ng ink droplet is ejected at the speed of 5 m/s toward the recording sheet 60 that is being fed in the direction A at a constant speed. As shown in FIG. 3, thus ejected ink droplet 14 will, if not deflected at all, travel straight to the recording sheet 60 along a center trajectory 90.

As shown in FIGS. 2 and 3, the orifice electrode 11 is formed to a plate shape from a material with electrical conductivity, such as a metal, and has a thickness of 0.5 mm. The orifice electrode 11 is attached to the orifice plate 15 along the nozzle line of the nozzle holes 12 while keeping a distance of approximately 300 $\mu$m between the orifice plate 15 and the nozzle line. The orifice electrode 11 as well as the orifice plate 15 and the ink filling in the nozzle elements 2 are electrically connected to the ground.

As shown in FIG. 3, the back electrode 30 is formed to a flat plate from a material with an electrical conductivity, such as metal. The back electrode 30 is placed in confrontation with the orifice plate 15 at a position 1.5 mm away from the surface of the orifice plate 15 such that the back electrode 30 extends parallel to the surface of the orifice plate 15. The back electrode 30 has the potential corresponding to that of the charging/deflecting signal shown in FIG. 5(*c*). Because the charging/deflecting signal of the present embodiment changes between −1 kV and 0V as mentioned above, the potential of the back electrode 30 also changes between −1 kV and 0V.

Figure 4:
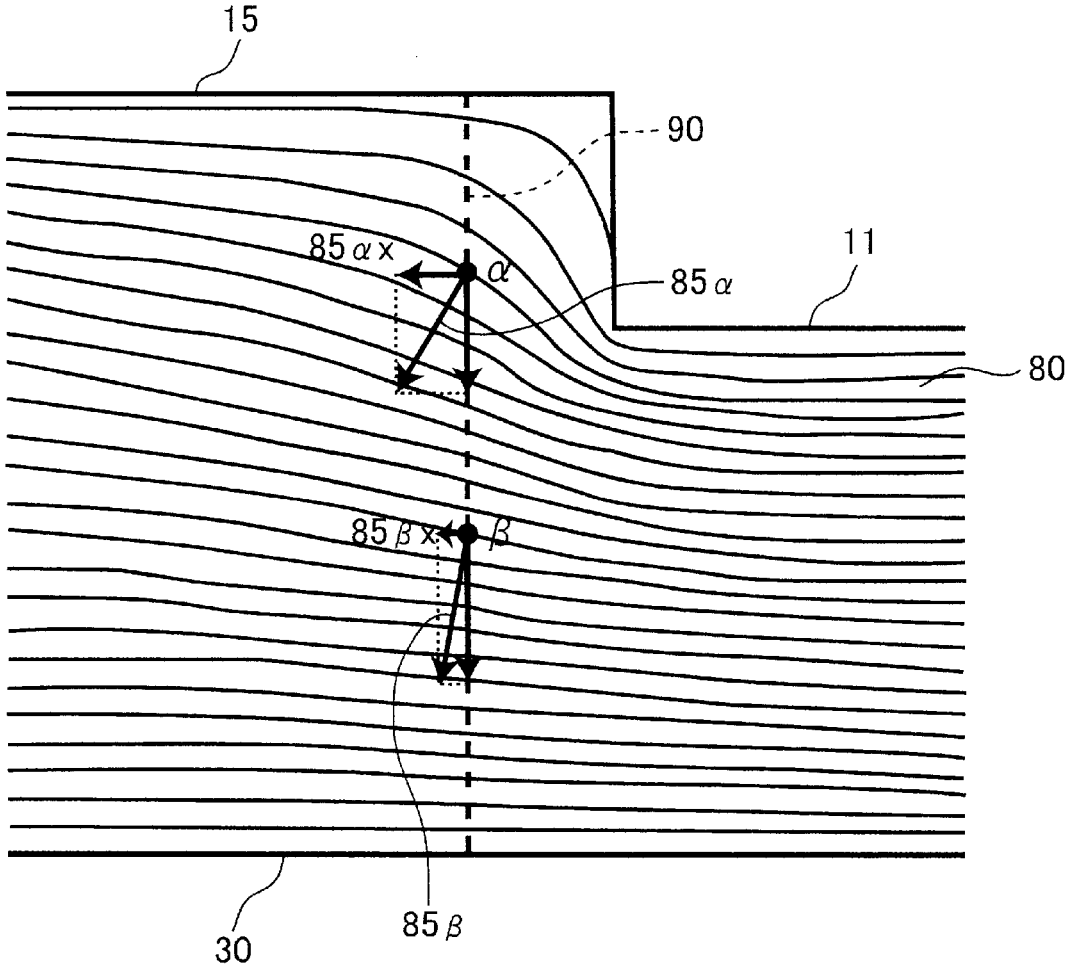
FIG. 4 is an equipotential surface of an electric field generated by the charging/deflection device of the embodiment.

As described above, the orifice electrode 11 and the orifice plate 15 are conductive and connected to the ground, and the back electrode 30 is applied with the charging/deflecting signal shown in FIG. 5(*c*) of either 0V or −1 kV. With this configuration, when the back electrode 30 is applied with the charging/deflecting signal of −1 kV, an inclined electric field 85 is generated between the orifice electrode 11 and the pressure chamber 13 and the back electrode 30 as shown in FIG. 3. FIG. 4 shows an equipotential surface 80 of the inclined electric field 85. As shown, contour lines of the inclined electric field 85 are inclined near the center trajectory 90 with respect to the surface of the orifice plate 15, and so the direction of the inclined electric field 85 is angled with respect to the center trajectory 90. This is because of the presence of the orifice electrode 11 that is electrically connected to the ground and protruding from the orifice plate 15 toward the back electrode 30.

Because of the inclined electric field 85, charged ink droplets can be effectively deflected as desired although the back electrode 13 serving as a deflector electrode is provided relatively far away from the nozzle hole 12. Details will be described next.

In the configuration described above, an ink droplet to be ejected through the nozzle hole 12 is selectively charged with a potential in accordance with the potential of the back electrode 30 at the time of ejection. Because, in this embodiment, the ink filling in the nozzle element 2 is connected to the ground and because the charging/deflecting signal changes its potential between 0V and −1 kV as described above, uncharged ink droplets having the potential of 0V and positively charged ink droplets are selectively ejected.

When an uncharged ink droplet is ejected, then the ink droplet travels straight along the center trajectory 90 without being deflected. On the other hand, when a positively charged ink droplet is ejected, then positively ink droplet is deflected to the left by the electric field 85 and travels along a deflected trajectory 91 shown in FIG. 3.

Now, as shown in FIG. 4, an electric field 85α and an electric field 85β have field elements 85αx, 85βx, respectively, which have a direction and pulls charged ink droplets toward the direction perpendicular to the center trajectory 90. However, the magnitude of the field element 85αx is greater than that of the field element 85βx at a position β, which is away from the nozzle hole 12 compared with the position α.

Accordingly, the charged ink droplets are deflected greatly at the position a that is an early flight stage, and so even greater deflection can be achieved as the flight proceeds. In this manner, although the back electrode 30 is positioned away from the nozzle hole 12, a desirable and sufficient deflection amount can be obtained.

FIGS. 5(*a*) through 5(*c*) are explanatory views of dot forming processes of the present embodiment. In this example, ink droplets 104 ejected from the nozzle holes 12 are selectively deflected to travel along either the center trajectory 90 or the deflected trajectory 91 and form a dot pattern shown in FIG. 5(*a*). FIG. 5(*b*) shows driving pulse signal from the second circuit 50, and FIG. 5(*c*) shows the charging/deflecting signal from the first circuit 40.

When a pulse b1 is applied to the piezoelectric element 55 in FIG. 5(*b*), then an ink droplet is in response ejected at the time T1, which is slightly after the application of the pulse b1. At this time, the back electrode 30 is being applied with a voltage c1, which is 0V, as shown in FIG. 5(*c*). Accordingly, the ink droplet ejected at the time T1 is uncharged. The charging/deflecting signal is switch from 0V to −1 kV immediately after the ink ejection (FIG. 5(*c*)), and so the electric filed 85 is generated, through which the uncharged ink droplet passes through. Although the electric filed 85 may induce charge transfer within the ink droplet, the uncharged condition of the ink droplet is maintained as a whole, so that the uncharged ink droplet travels along the center trajectory 90 without being deflected at all, and then alights the recording sheet 60 to form a dot a1 thereon (FIG. 5(*a*)).

When a predetermined time duration has passed, a pulse b2 is applied to the piezoelectric element 55. An ink droplet is ejected through the nozzle hole 12 at the time T2, which is slightly after the application of the pulse b2. The voltage of the charging/deflecting signal at the time T2 is −1 kV as shown in FIG. 5(*c*), and so the back electrode 30 is maintained at −1 kV. Accordingly, the ink droplet ejected at the time T2 is positively charged with a predetermined potential. Thus charged ink droplet is deflected by the inclined electric field 85, travels along the deflected trajectory 91, and alights the recording sheet 60 to form a dot a2 (FIG. 5(*a*)).

At the time T3, because no pulse is applied to the piezoelectric element 55 (FIG. 5 (*b*)), no ink droplet is ejected. Accordingly, no dot is formed on a position a3 of the recording sheet 60. The same is true for the time T4 and the time T5 also, and so no dot is formed on positions a4, a5.

At the time T6, an ink droplet ejected in response to a pulse b6 is positively charged, deflected by the inclined electric field 85, and forms a dot a6 on the recording sheet 60, in the same manner as at the timing T2. Repeating these processes provides a desired image on the recording sheet 60.

In this manner, by controlling the ejection timing of ink droplet in association with the potential of the charging/deflecting signal, the impact positions are controlled.

Although, in the above described example, ink droplets are selectively deflected to the left in FIG. 3 so as to travel along the deflected trajectory 91 or simply along the center trajectory 90 without being deflected. However, ink droplets can also be deflected to the right to travel along a deflected trajectory 92 so that ink droplets can be deflected both to the right and the left of the center trajectory 90. In this case, the charging/deflecting voltage that changes between −1 kV and +1 kV as shown in FIG. 5(*d*) is applied to the back electrode 30. For example, an ink droplet ejected in response to a pulse d1 of +1 kV (FIG. 5(*d*)) is negatively charged, and is deflected to a direction opposite to a positively charged ink droplet to travel along the deflected trajectory 92.

As shown in FIG. 5(*e*), a charging/deflecting signal that changes among −1 kV, +1 kV and two other potentials between −1 kV and +1 kV can be applied to the back electrode 30 instead. In this case, ink droplets ejected through the same single nozzle hole 12 can be deflected by one of four deflection amounts, so that the single nozzle element 13 can form dots on four different scanning lines. This is because that the deflection amount of ink droplets depends on the charging amount of the ink droplets, which is in approximate proportion to the potential of the charging/deflecting signal at the time of ejection. In other words, the charged ink droplets are deflected by the inclined electric field 85 by an amount corresponding to its potential.

Rather than only 1, 2, or 4, greater numbers of deflections can be realized according to the above principle.

Within the inclined electric field 85, ink droplets are either accelerated or decelerated in its ejection direction. This may causes resultant dot being shifted from a target position on the recording sheet 60. When this position shift is significant, the deflection directions and/or ink ejection timings can be adjusted to compensate for the position shift.

The deflection amount can be adjusted by changing the potential of the charging/deflecting signal.

As described above, according to the present invention, because the orifice electrode 11 has the same potential as that of the orifice plate 15, even when the orifice electrode 11 get wet with ink, no problems occur. That is, electrically insulated electrode is dispensed with from the position along the trajectory of ejected ink droplets. Therefore, there is no danger that the above-described problems that the conventional devices have occur.

By properly adjusting the nozzle pitch, the ink ejection timing, the deflection direction, and the deflection amount, it is possible to form each dot on a recording sheet with a plurality of ink droplets from different nozzles. That is, the plurality of ink droplets from different nozzles alight the same or near the same spot to form a signal dot. In this case, even if one or ones of the different nozzles become defective, the dot is still printed by the remaining nozzle(s). Also, because each dot is formed by a plurality of different nozzles, unevenness in color density of the printed image due to uneven characteristics among the plurality of nozzles can be canceled out, and so a high quality image without uneven color density can be provided.

While some exemplary embodiments of this invention have been described in detail, those skilled in the art will recognize that there are many possible modifications and variations which may be made in these exemplary embodiments while yet retaining many of the novel features and advantages of the invention.

Figure 6:
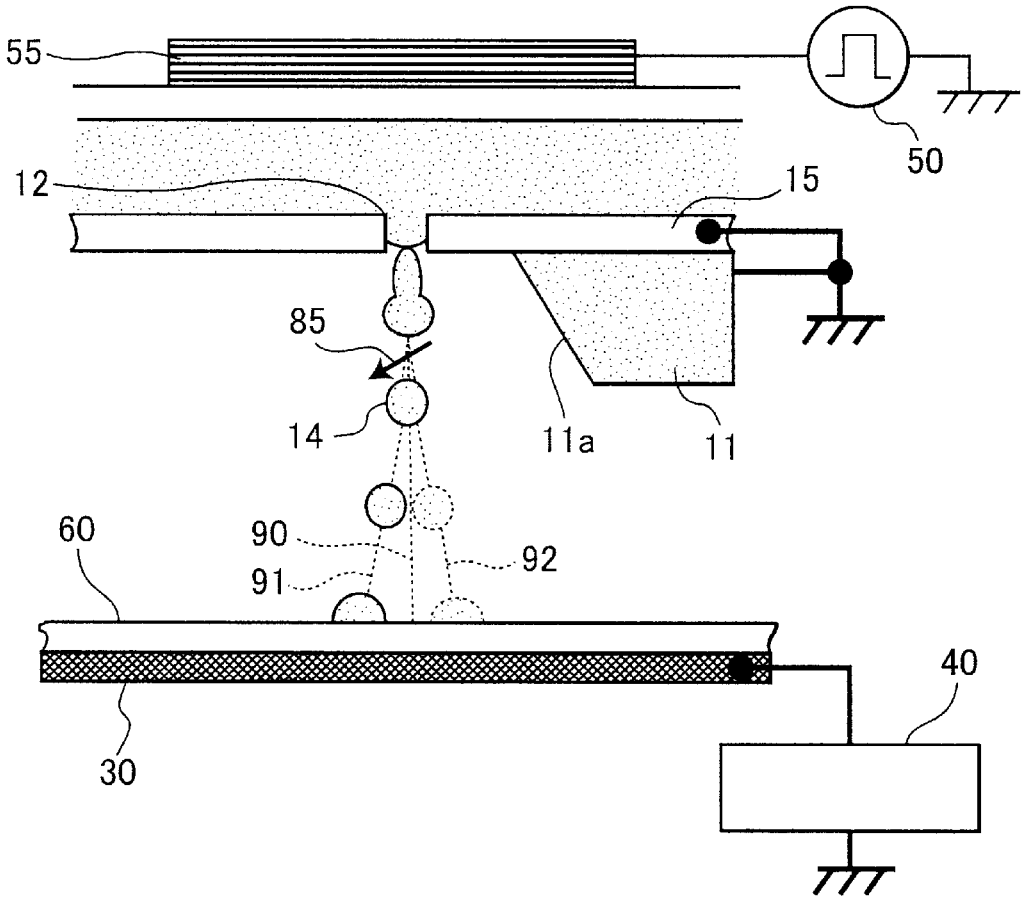
FIG. 6 is a plan view of a modified configuration of the charging/deflecting device of the embodiment.
Figure 7:
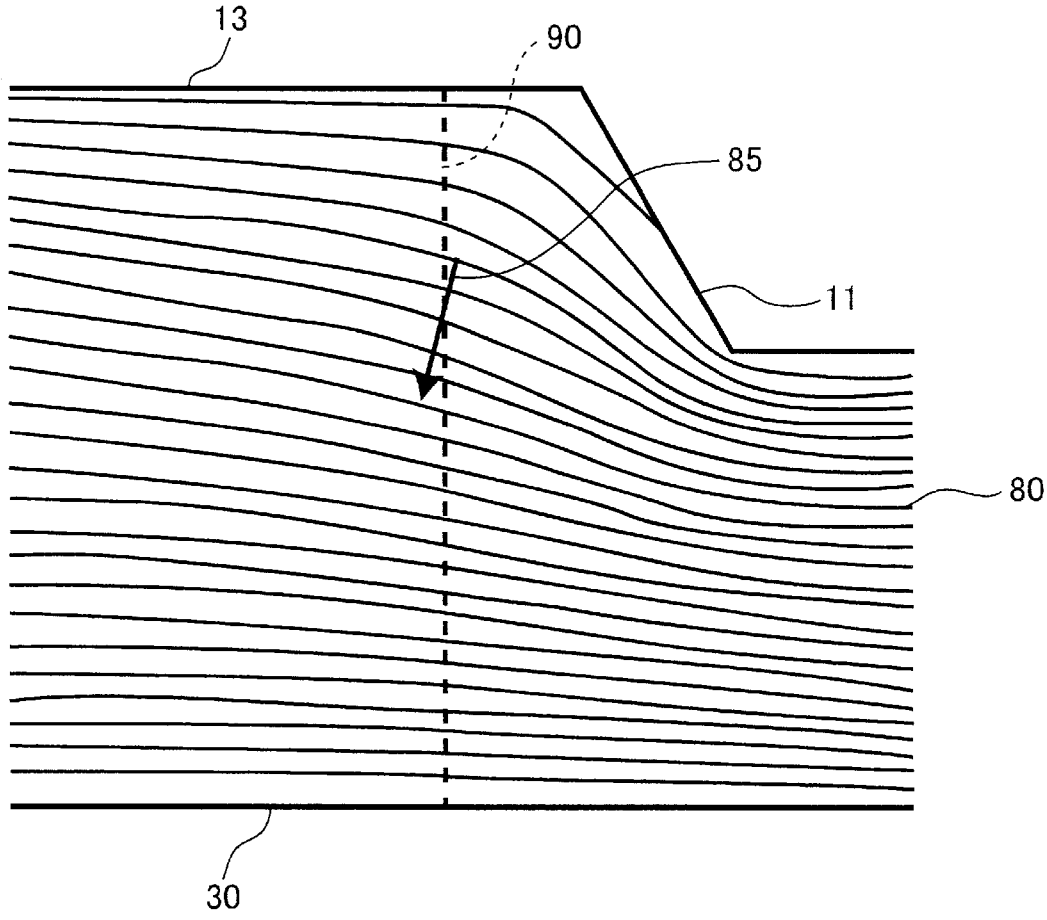
FIG. 7 is an equipotential surface of an electric field generated by the charging/deflection device of FIG. 6.

For example, as shown in FIG. 6, the orifice electrode 11 can have a trapezoid cross-section with a slanted side surface 11*a* near the nozzle hole 12. With this configuration also, the inclined electric field 85 can be generated as shown in FIG. 7, and so deflection is possible. Because of the slanted side surface 11*a*, during a well known wiping operation for removing ink from the surface of the orifice plate 15, a wiper made from a rubber, for example, will be prevented from getting stuck on the orifice electrode 11, so the wiping operation can be smoothly performed.

The orifice electrode 11 is not limited to the rectangular or trapezoid shape, but can be any other shape or has a rounded edge. Also, the orifice electrode 11 is not necessarily attached to the orifice plate 15, but can be positioned separated from the orifice plate 15 as long as the inclined electric field can be generated.

Figure 8:
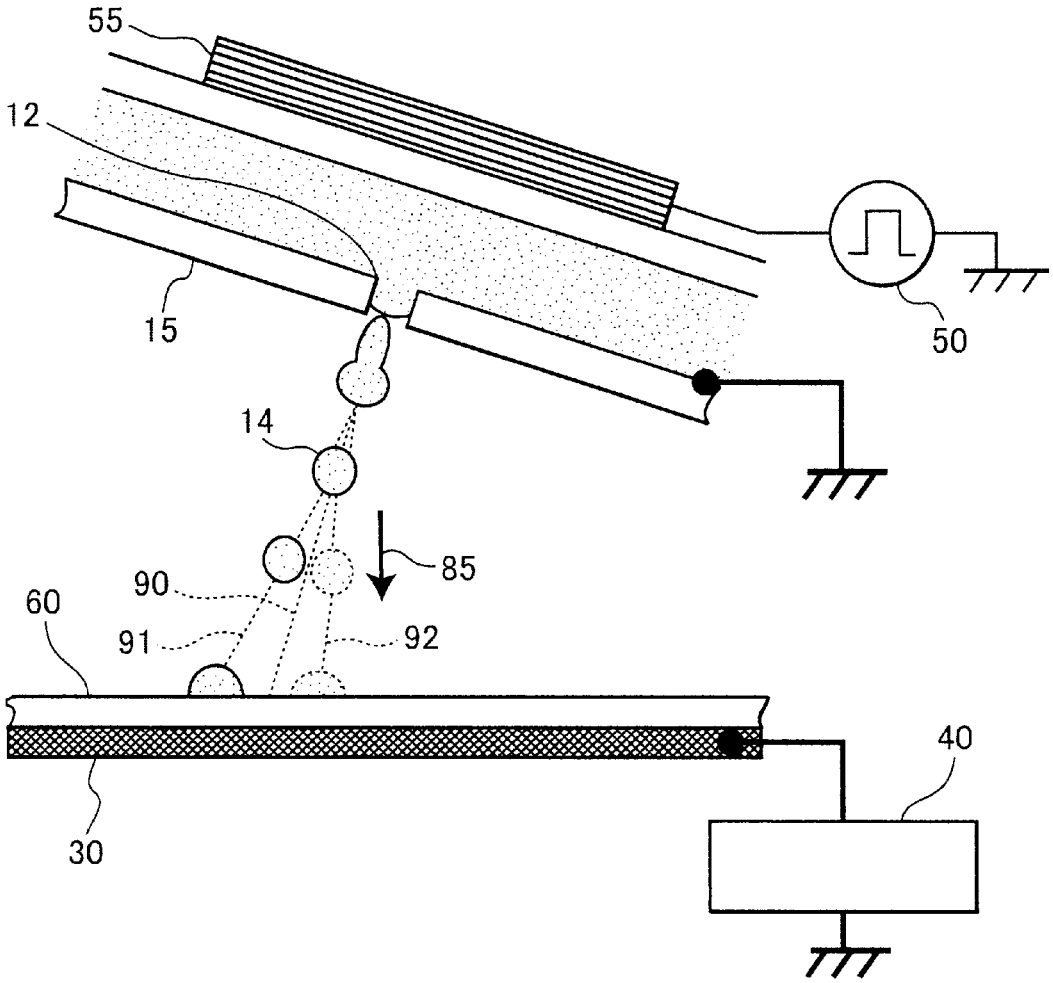
FIG. 8 is a plan view of another modified configuration of the charging/deflecting device of the embodiment.

Further, as shown in FIG. 8, the orifice electrode 11 can be dispensed with and the orifice plate 15 can be positioned inclined with respect to the back electrode 30. In this case also, the inclined electric field can be generated, and so the deflection can be realized. Because the orifice electrode 11 can be dispensed with, the configuration of the ink jet printer 100 is simplified.

Moreover, the back electrode 30 is not limited to a flat plate shape, but can be a drum with an arc surface, for example.

What is claimed is:

1. A charging/deflecting device used in a device including a nozzle member that is formed with an ink chamber filled with an ink and an ejection means for ejecting a portion of the ink as an ink droplet to a predetermined direction, the charging/deflecting device comprising:

an electrically conductive member provided near a position where the ink droplet is separated from the remaining ink at the time of ejection, the electrically conductive member has the same potential as the potential of the ink filling in the ink chamber;

a back electrode positioned defining a space between the electrically conductive member through which a recording medium passes; and an application member that selectively applies an electric voltage to the back electrode, thereby generating an inclined electric field between the electrically conductive member and the back electrode.

2. The charging/deflecting device according to claim 1, wherein the inclined electric field has a field element in a direction perpendicular to the predetermined direction, the field element pulls the ink droplet in flight toward the direction perpendicular to the predetermined direction.

3. The charging/deflecting device according to claim 1, wherein the electrically conductive member has a surface and a protrusion protruding from the surface toward the back electrode, the protrusion being formed at one side of the position where the ink droplet is separated from the remaining ink.

4. The charging/deflecting device according to claim 1, wherein the electrically conductive member includes an orifice plate and a conductive plate attached on the orifice plate, the orifice plate being formed with a hole through which the ink droplet is ejected.

5. The charging/deflecting device according to claim 1, wherein the electrically conductive member has a surface opposing a surface of the back electrode, the surface of the electrically conductive member being inclined with respect to the surface of the back electrode.

6. The charging/deflecting device according to claim 1, wherein the electrically conductive member is electrically connected to the ground, and the application member applies the back electrode with the electric voltage that changes its potential on a time basis.

7. The charging/deflecting device according to claim 6, wherein the ink droplet is selectively deflected by the inclined electric field by an amount corresponding to the potential of the ink droplet.

8. The charging/deflecting device according to claim 7, further comprising a control means for controlling the potential of the driving voltage.

9. An ink jet recording device comprising:

a nozzle member that is formed with an ink chamber filled with an ink;

an ejection means for ejecting a portion of the ink as an ink droplet;

an electrically conductive member provided near a position where the ink droplet is separated from the remaining ink at that time of when the ink droplet is ejected by the ejection means, the electrically conductive member has the same potential as the potential of the ink filling in the ink chamber;

a back electrode positioned defining a space between the electrically conductive member through which a recording medium passes; and an application member that selectively applies an electric voltage to the back electrode, thereby generating an inclined electric field between the electrically conductive member and the back electrode.

10. The ink jet recording device according to claim 9, wherein the electrically conductive member has a surface and a protrusion protruding from the surface toward the back electrode, the protrusion being formed at one side of the position where the ink droplet is separated from the remaining ink.

11. The ink jet recording device according to claim 9, wherein the electrically conductive member has a surface opposing a surface of the back electrode, the surface of the electrically conductive member being inclined with respect to the surface of the back electrode.

* * * * *